US009068289B2

(12) United States Patent
Moon et al.

(10) Patent No.: US 9,068,289 B2
(45) Date of Patent: Jun. 30, 2015

(54) ACCESSORY FOR CLOTHES DRYER

(71) Applicant: LG Electronics Inc., Seoul (KR)

(72) Inventors: Taechul Moon, Seoul (KR); Kayeon Kim, Seoul (KR); Ayeong Lee, Seoul (KR); Sogkie Hong, Seoul (KR); Junghwan Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 13/652,106

(22) Filed: Oct. 15, 2012

(65) Prior Publication Data

US 2013/0097896 A1 Apr. 25, 2013

(30) Foreign Application Priority Data

Oct. 20, 2011 (KR) ..... 10-2011-0107563

(51) Int. Cl.

| | |
|---|---|
| ***D06C 3/00*** | (2006.01) |
| ***D06F 59/02*** | (2006.01) |
| ***D06F 58/10*** | (2006.01) |
| ***D06F 73/00*** | (2006.01) |
| *D06F 59/00* | (2006.01) |

(52) U.S. Cl.
CPC *D06F 58/10* (2013.01); *D06C 3/00* (2013.01); *D06F 59/00* (2013.01); *D06F 73/00* (2013.01)

(58) Field of Classification Search
CPC ..... D06F 59/00; D06F 59/02; D06F 60/00; D06F 57/00; D06C 3/00
USPC ..... 223/61–74, 85; 38/12, 1 A, 69, 70, 102, 38/14; 8/149.3; 81/302
See application file for complete search history.

(56) References Cited

U.S. PATENT DOCUMENTS

| | | | | | |
|---|---|---|---|---|---|
| 334,927 | A | * | 1/1886 | Barnum | 223/69 |
| 522,991 | A | | 7/1894 | Laubin | |
| 1,580,958 | A | | 4/1926 | Chapman | |
| 1,940,600 | A | * | 12/1933 | Maves et al. | 38/102 |
| 1,962,889 | A | * | 6/1934 | Bateman | 38/102 |
| 2,586,909 | A | * | 2/1952 | Blackman | 223/74 |
| 2,635,368 | A | * | 4/1953 | Greb-Lasky | 38/70 |
| 4,493,160 | A | * | 1/1985 | Brembilla et al. | 38/14 |
| D335,602 | S | * | 5/1993 | Magaard | D6/553 |
| 5,269,497 | A | * | 12/1993 | Barth | 267/110 |
| 5,305,484 | A | | 4/1994 | Fitzpatrick et al. | |
| 6,813,852 | B1 | * | 11/2004 | Uchikoshi | 38/66 |
| 7,677,141 | B1 | * | 3/2010 | Crew | 81/302 |
| 8,028,868 | B2 | * | 10/2011 | Mangano | 223/85 |

FOREIGN PATENT DOCUMENTS

| | | | |
|---|---|---|---|
| CN | 101349000 | A | 1/2009 |
| DE | 91 02 303 | U1 | 5/1991 |
| DE | 20 2006 000 337 | U1 | 5/2007 |
| DE | 10 2008 051 257 | A1 | 5/2009 |
| EP | 1 208 778 | A2 | 5/2002 |
| FR | 2 923 499 | A1 | 5/2009 |

* cited by examiner

*Primary Examiner* — Ismael Izaguirre
(74) *Attorney, Agent, or Firm* — McKenna Long & Aldridge LLP

(57) ABSTRACT

An accessory for a clothes dryer is disclosed. The accessory for the clothes dryer is installed to clothes that will be dried in the clothes dryer, and serves not only to smooth out wrinkles in the clothes, but also to pleat the clothes. The accessory for the clothes dryer includes a load member, which is inserted into a predetermined portion of clothes in a state in which the cloths are accommodated in the clothes dryer and which serves to downwardly apply tension to the clothes, and an anti-slip member configured to prevent the load member from being separated from the clothes.

16 Claims, 7 Drawing Sheets

ACCESSORY FOR CLOTHES DRYER

This application claims the benefit of Korean Patent Application No. 10-2011-0107563, filed on Oct. 20, 2011, which is hereby incorporated by reference as if fully set forth herein.

BACKGROUND OF THE INVENTION

1. Field of the Invention

The present invention relates to an accessory for a clothes dryer, which is installed to clothes that will be dried in the clothes dryer and which serves not only to smooth out wrinkles in the clothes, but also to pleat the clothes.

2. Discussion of the Related Art

In general, a dryer is a home appliance that typically dries a completely washed laundry, i.e. an object to be dried, using hot air.

Dryers may be classified, based on an air heating method, i.e. based on heating means, into an electric dryer and a gas dryer. The electric dryer is designed to heat air using electric resistance heat generated from an electric heater, and the gas dryer is designed to heat air using heat generated by combustion of gas within a gas burner.

Alternatively, dryers may be classified into a condensing (circulating) dryer and an exhaust dryer. In the condensing dryer, wet air, which has been generated via heat exchange with an object to be dried within a drum, is circulated within the dryer rather than being discharged outward, and then is heat exchanged with outside air within a condenser to generate condensed water to be discharged outward. In the exhaust dryer, wet air, which has been generated via heat exchange with an object to be dried within a drum, is directly discharged outward from the dryer.

Further, dryers may be classified into a top loading dryer and a front loading dryer based on a method for putting an object to be dried into the dryer. The top loading dryer is configured such that an object to be dried is put from the top of the dryer, and the front loading dryer is configured such that an object to be dried is put from the front of the dryer.

Furthermore, dryers may be classified into a drum type dryer and a cabinet type dryer. The present invention refers to an accessory for use in the cabinet type dryer, and a description of the drum type dryer will be omitted hereinafter.

There is Korean Registered Patent Application No. 10-2007-0018389 (entitled "DRYER AND CONTROL METHOD THEREOF") in relation to the cabinet type dryer.

Considering the aforementioned related art with reference to FIG. 1, the dryer includes a cabinet 10 in which an object to be dried is accommodated, a low-temperature air generating unit (not shown) which generates relatively low-temperature air to be supplied into the cabinet in order to dry the object to be dried; and a path (not shown) through which the relatively low-temperature air generated by the low-temperature air generating unit is supplied into the cabinet. The dryer preferably further includes a moisture ejection unit (not shown) to supply moisture into the cabinet. Differently from the drum type dryer, clothes accommodated in the cabinet remain stationary. To this end, a supporting member 5, on which clothes hangers are supported, is preferably provided inside the cabinet.

With the above-described related art, the supporting member 5 may prevent friction between the cabinet and the clothes and between the clothes during drying of the clothes. Moreover, the moisture ejection unit (not shown) may serve to smooth out the creases, wrinkles and folded lines (hereinafter referred to as the generic term "wrinkles") in the clothes to be dried.

However, the above-described conventional dryer has the following problems.

Firstly, although using the moisture ejection unit may effectively smooth out the wrinkles to some extent, completely smoothing out the wrinkles in the clothes is impossible. Thus, it is necessary for a user to iron out the wrinkles in the clothes.

Secondly, in the case of clothes that are impossible to iron, completely smoothing out the wrinkles in the clothes is impossible.

SUMMARY OF THE INVENTION

Accordingly, the present invention is directed to an accessory for a clothes dryer that substantially obviates one or more problems due to limitations and disadvantages of the related art.

One object of the present invention is to provide an accessory for a clothes dryer, which is used to smooth out wrinkles in clothes and allows a user to intuitively know a use method thereof.

Another object of the present invention is to provide an accessory for a clothes dryer, which has high durability and low manufacturing costs.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an accessory for a clothes dryer includes a load member which is inserted into a predetermined portion of clothes in a state in which the cloths are accommodated in the clothes dryer and which serves to downwardly apply tension to the clothes, and at least one anti-slip member configured to prevent the load member from being separated from the clothes.

The load member may be inserted into a folded portion of the clothes in a state in which the folded clothes are accommodated in the clothes dryer.

The load member may have an elongated bar shape.

At least a portion of an outer circumference of the load member may be curved.

The load member may have a streamlined semicircular cross section.

The load member may have a circular cross section.

The load member may be formed of a stainless material or thermosetting resin.

The at least one anti-slip member may include two anti-slip members provided respectively at both longitudinal ends of the load member.

The anti-slip member may be formed of a stainless material or thermosetting resin.

The anti-slip member may be separably coupled to the load member.

The anti-slip member may include a recess or protrusion to be coupled to the load member, and the load member may include a protrusion or recess corresponding to the recess or protrusion of the anti-slip member.

The accessory for the clothes dryer may further include a centroid member which serves as the center of gravity of the load member to prevent the load member from being rotated in the folded portion of the clothes.

The centroid member may be movably located inside the load member.

The centroid member may be fixed inside the load member.

The load member and the centroid member may be integrally formed with each other.

The load member may be length-adjustable to enable adjustment in the length thereof.

The load member may include a first load member, a second load member, and a connection member configured to connect the first and second load members to each other, one end of the connection member may be coupled to the first load member and the other end of the connection member may be coupled to the second load member.

At least one of the first load member and the second load member may include an inserting region, into which the connection member is inserted, and the length of the load member may vary according to the length of a portion of the connection member inserted into the inserting region.

At least one of both ends of the connection member may be provided with a stopper to prevent the connection member from being separated from the inserting region.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
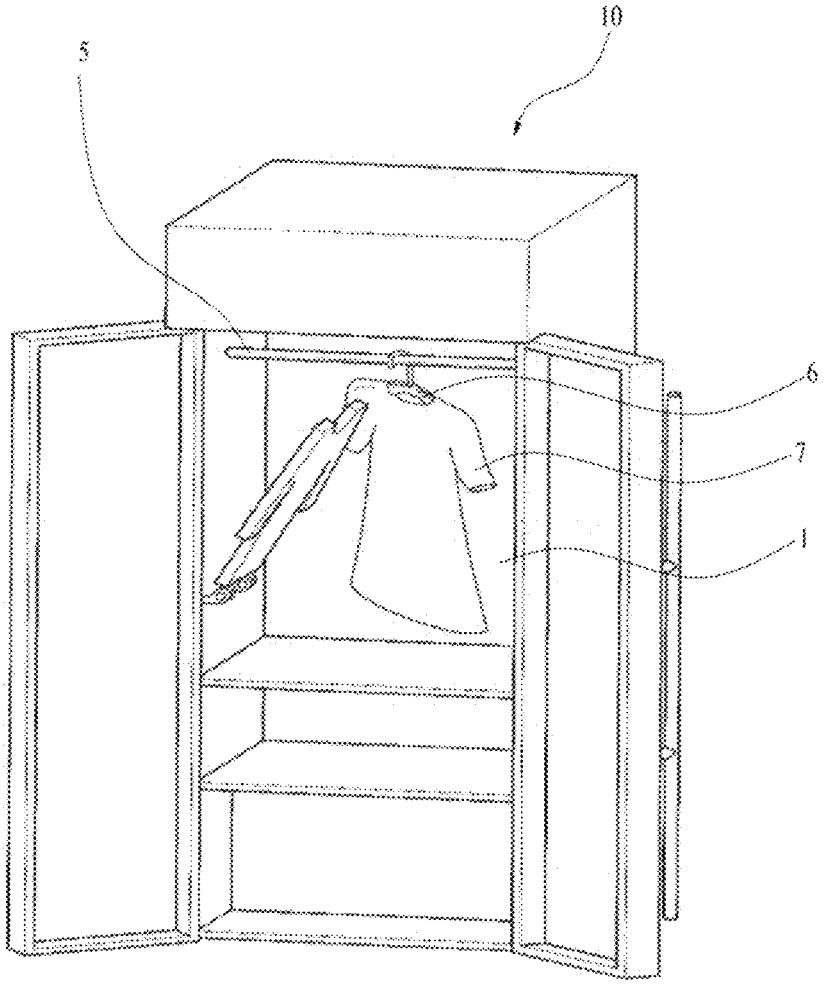
FIG. 1 is a perspective view illustrating a cabinet type dryer.

Hereinafter, the exemplary embodiments of the present invention will be described in detail with reference to the accompanying drawings.

So long as being not specially defined, all terms in the context of describing the invention may be commonly understood by those skilled in the art to have the same meaning as the general meaning, or may be dedicatedly defined in the specification when having a specific meaning conflicting with the general meaning thereof.

It is to be understood that the invention, which will be disclosed hereinafter, is intended to describe the exemplary embodiments of the present invention and is not intended to limit the scope of the present invention. The same reference numerals throughout this specification denote the same constituent elements.

To solve the above-described problems of the related art, an accessory, which is capable of certainly smoothing out the wrinkles in clothes by applying tension to the clothes, is being commercialized.

Figure 2:
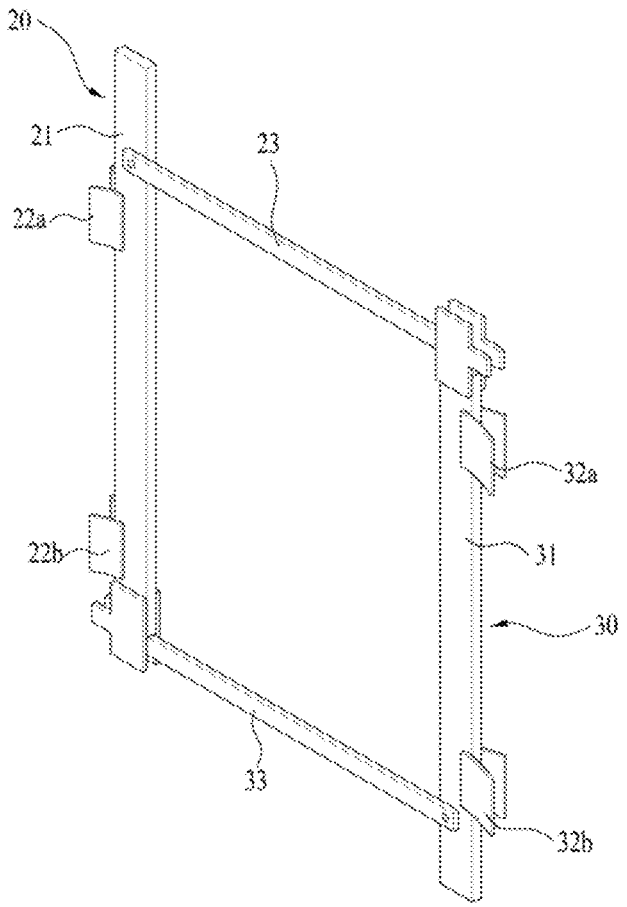
FIG. 2 is a perspective view illustrating a fixing clamp which will be fixed to clothes to smooth out wrinkles.
Figure 3:
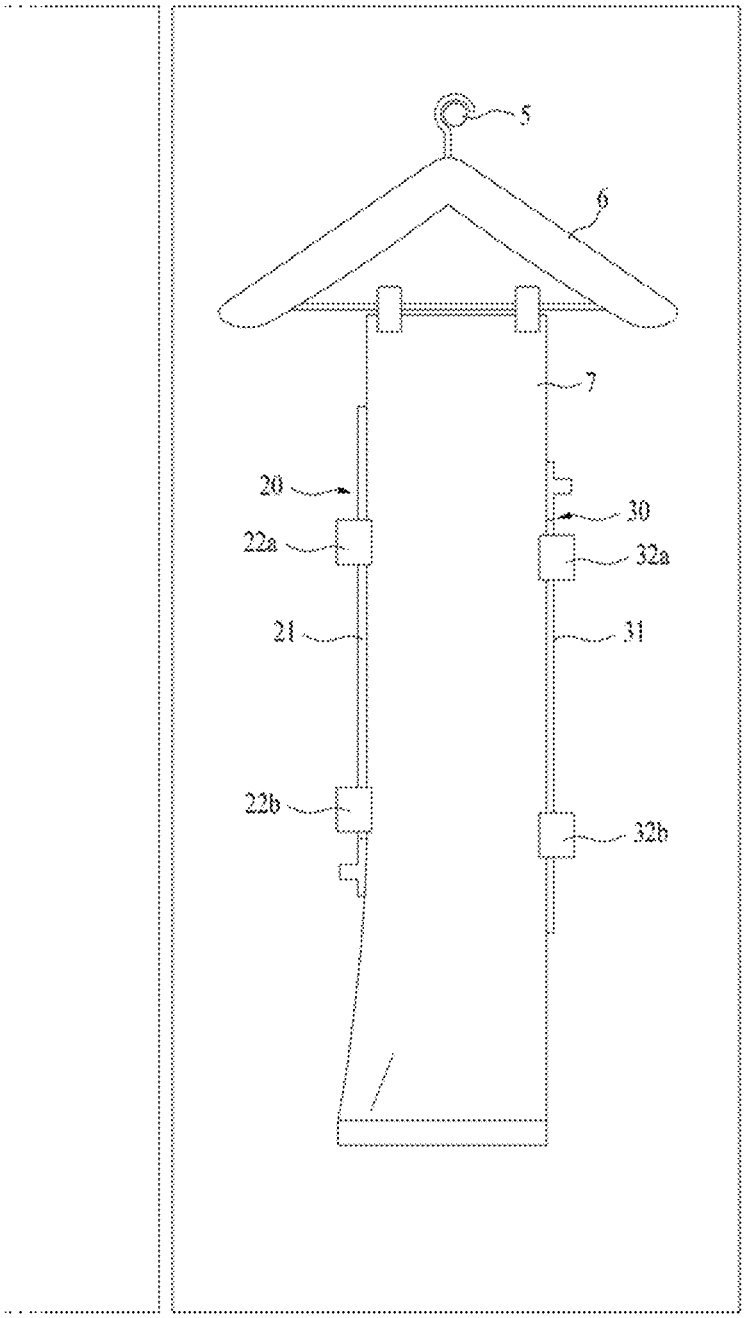
FIG. 3 is a view illustrating a use state of the fixing clamp of FIG. 2.

FIGS. 2 and 3 are views illustrating fixing clamps 20 and 30 as one aspect of an accessory for a clothes dryer according to the present invention, and a use state of the fixing clamps with clothes (for example, pants 7).

Referring to FIG. 2, such fixing clamps include a first fixing clamp 20 and a second fixing clamp 30. Each of the clamps 20 and 30 includes an elongated bar shaped body 21 or 31, two clothespins 22*a* and 22*b* or 32*a* and 32*b* provided at the body 21 or 31, and a fixing member 23 or 33 pivotally rotatably mounted to one end of the body 21 or 31 so as to be coupled to the body of the other clamp.

Explaining a use method of the fixing clamps 21 and 32 with reference to FIG. 3, in a state in which the clothes 7 are hung on one end of the clothes dryer 10 via a clothes hanger 6, the first clamp 20 is coupled to one end of the clothes 7 using the clothespins 22*a* and 22*b*. Thereafter, the second clamp 30 is coupled to the other end of the clothes 7 using the same method. In this case, the first clamp 20 and the second clamp 30 have to be installed in parallel to each other. After the two clamps 20 and 30 are coupled to opposite ends of the clothes 7 in parallel to each other, each fixing member 23 or 33, which is pivotally rotatably mounted to one end of the body 21 or 31 of one fixing clamp 20 or 30, is pivotally rotated so as to be connected to the body 31 or 21 of the other fixing clamp 30 or 20.

That is, the fixing clamps 20 and 30 may serve to apply tension to the clothes 7, which has the effect of smoothing out the wrinkles in the clothes.

However, the above-described fixing clamps still have the following problems.

Firstly, the fixing clamps may have considerable deterioration in practicality due to a complicated complex use method thereof.

Secondly, if any one of the two clamps is destroyed or damaged, the entire accessory is useless.

Thirdly, the fixing clamp consists of a relatively great number of elements, which may result in low effectiveness in terms of durability and manufacturing costs.

Fourthly, a portion of the clothes not, to which no tension is applied by the fixing clamps, may remain wrinkled.

To solve the above-described problems, accessories 100 and 200 usable with the clothes dryer according to different embodiments of the present invention will be described hereinafter with reference to FIGS. 4 and 7.

Figure 4:
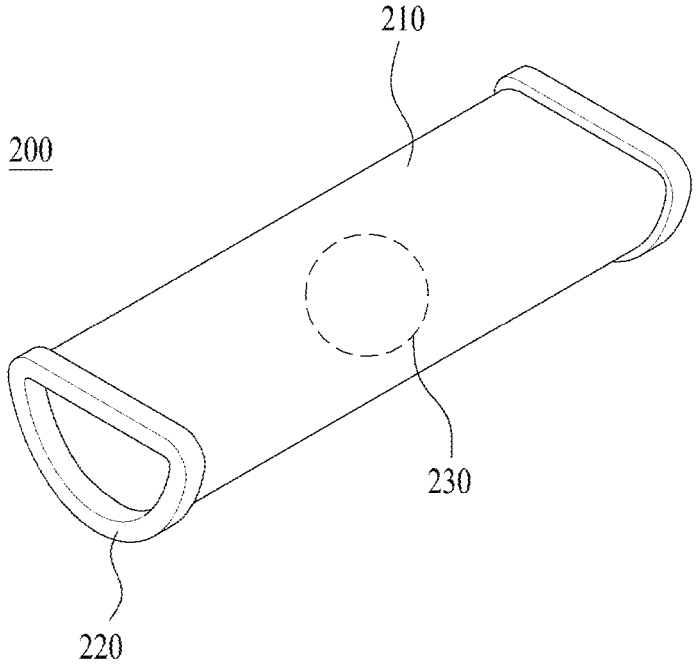
FIG. 4 is a perspective view illustrating a semi-cylindrical accessory for a clothes dryer according to an embodiment of the present invention.

FIG. 4 is a perspective view illustrating the semi-cylindrical accessory 200 for the clothes dryer according to one embodiment of the present invention. FIG. 7 is a perspective view illustrating the cylindrical accessory 100 for the clothes dryer according to another embodiment of the present invention.

Figure 7:
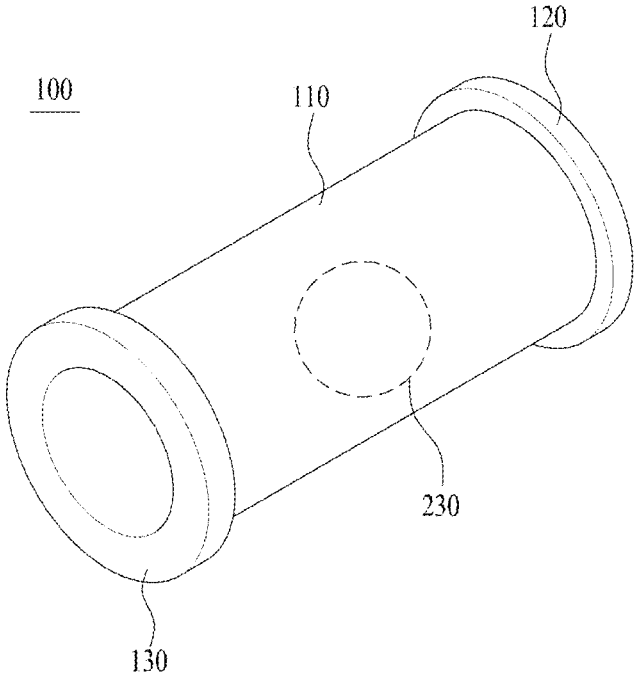
FIG. 7 is a perspective view illustrating a cylindrical accessory for a clothes dryer according to another embodiment of the present invention.

Referring to FIGS. 4 and 7, according to the present invention, the accessory 100 or 200 include a load member 110 or 210, anti-slip members 120 and 220, and a centroid member 230.

The load member 110 or 210 serves to downwardly apply tension to the clothes. In this case, the term "downward" may mean a direction in which gravitational force acts. In a state in which the folded clothes 7 are hung on the supporting member 5 provided at one end of the cabinet 1 of the clothes dryer 10 via the clothes hanger 6, for example, the load member 110 or 210 is inserted into a folded portion of the clothes 7, thereby serving to downwardly apply tension to the clothes 7. In this case, the clothes may be hung on the supporting member 5 in a half folded state. The clothes, to which the load member 110 or 210 is inserted, may be tops, such as a jacket and a coat, and may be bottoms, such as pants. Preferably, the present invention may be applied to the bottoms.

The load member 110 or 210 serves to smooth out the wrinkles in the clothes 7. Therefore, a portion of the load member 110 or 210 that comes into contact with the clothes 7 preferably has a gentle curvature.

The load member 110 may have a cylindrical shape, and the load member 210 may have a semi-cylindrical shape. To ensure that the load member is stably accommodated within the clothes dryer when not in use, the semi-cylindrical load member 210 is more preferable.

More specifically, the load member 110 or 210 preferably has an elongated bar shape. In addition, at least a portion of a longitudinal outer circumference of the load member 110 or 210 may be curved. In this case, the curved portion of the outer circumference of the load member 110 or 210 preferably comes into contact with the folded portion of the clothes. As such, it is possible to prevent the folded portion of the clothes from being wrinkled by the load member 110 and 210. In this case, the load member may have a semi-circular cross section (see FIG. 4), and preferably has a streamlined semi-circular cross section. The streamlined semi-circular shape means that a point where a flat portion and a semi-circular portion of the outer circumference of the load member has a predetermined curvature. Alternatively, the load member may have a circular cross section (see FIG. 7).

The load member 110 or 210 may be a hollow member having a through-bore in which the centroid member 230 that will be described hereinafter is accommodated.

In this case, both longitudinal ends of the load member 110 or 210 are preferably open. The open ends of the load member 110 or 210 may assist a user in easily gripping the accessory 100 or 200, and may also result in more economic manufacture and rapid production.

In addition, since the interior of the clothes dryer 10, in which the load member 110 or 210 is accommodated, is under a high temperature and high humidity environment because of hot air and wet clothes, the load member 110 or 210 is preferably formed of a material not affected by the aforementioned environment. Thus, the load member 110 or 210 is preferably formed of a stainless material or thermosetting resin in consideration of the aforementioned interior environment of the clothes dryer 10.

The load member 110 or 210 is used to be inserted into a lower end of the half folded clothes 7 so as to apply tension to the clothes 7. To this end, the load member 110 or 210 must be weighty. However, if the load member 110 or 210 has an excessively great weight, it may cause extension of the clothes 7. Therefore, it is important to determine an appropriate weight of the load member 110 or 210, and it is preferable that the weight of the accessory 100 or 200 for the clothes dryer be 800 g.

The anti-slip members 120 or 220 serve to prevent unwanted separation of the load member 110 or 210 from the folded portion of the clothes. The anti-slip members 120 or 220 may be formed at a part of the load member 110 or 210. Preferably, the anti-slip members 120 or 220 are provided at both longitudinal ends of the load member 110 or 210.

Figure 5:
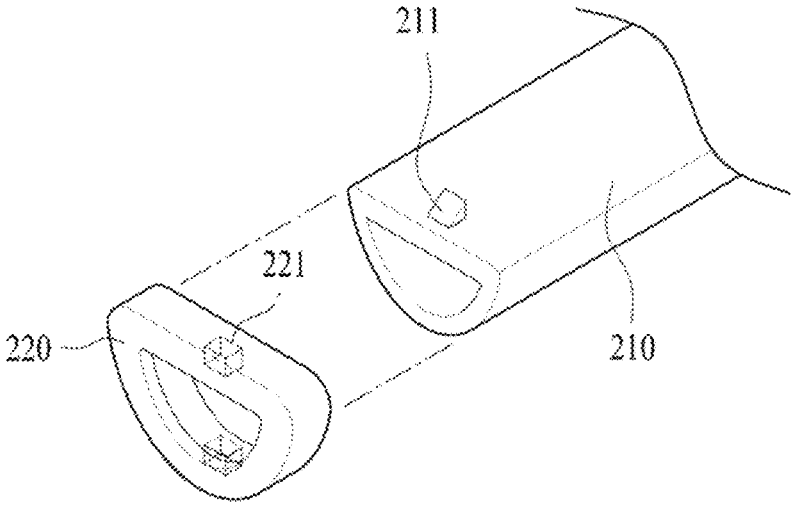
FIG. 5 is a view illustrating a coupling relationship between a load member and an anti-slip member included in the accessory for the clothes dryer according to the embodiment of the present invention.
Figure 6:
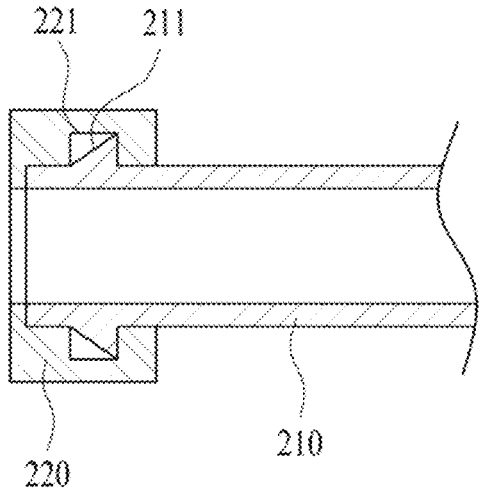
FIG. 6 is a side view illustrating a coupled state of the load member and the anti-slip member based on the coupling relationship of FIG. 5.

More specifically, the anti-slip members 120 or 220 may be integrally formed with the load member 110 or 210 by injection molding, or may be separably fitted to the load member 110 or 210. Referring to FIGS. 5 and 6, to achieve firm coupling between the load member 110 or 210 and the anti-slip members 120 or 220, preferably, each anti-slip member 120 or 220 may be provided at one side thereof with a recess 221 or a protrusion (not shown), and the load member 110 or 210 may be provided with a protrusion 211 or a recess (not shown) corresponding to the recess 221 or the protrusion (not shown) of the anti-slip member 120 or 220.

The anti-slip members 120 or 220 serve to prevent the accessory 100 or 200 for the clothes dryer from being moved relative to the clothes 7 while the accessory 100 or 200 for the clothes dryer according to the present invention is inserted into the clothes 7. This is because hot air flows within the clothes dryer 10 according to the present invention during drying and may cause the accessory 100 or 200 for the clothes dryer to be separated from the clothes 7. In addition, if the clothes dryer is equipped with a moving hanger on which the clothes are hung, there is a risk of the load member 110 or 210 being separated from the clothes as the moving hanger is moved vertically or horizontally.

To solve the above-described problem, the anti-slip members 120 or 220 are preferably provided at both longitudinal ends of the load member 110 or 210.

Additionally, the anti-slip members 120 and 220 preferably have a greater circular constant than the load member 110 or 210 and define stepped portions at both longitudinal ends of the load member 110 or 210. The anti-slip members 120 and 220 are preferably formed of frictional thermosetting resin.

The centroid member 230 functions to prevent the accessory 100 or 200 for the clothes dryer according to the present invention from being rotated after being inserted into the clothes. If the centroid member 230 is installed to protrude outward from the load member 110 or 210, this may cause deterioration in wrinkle smoothing effects of the load member 110 or 210. Therefore, the centroid member 230 is preferably located inside the load member 110 or 210.

Accordingly, in the case in which the accessory 100 and 200 for the clothes dryer according to the present invention is provided with the centroid member 230, the load member 110 or 210 preferably takes the form of a hollow member having a through-bore.

The centroid member 230 may be movably placed in the load member 110 or 120, or may be fixed. In the case in which the centroid member 230 is movable, both longitudinal ends of the load member 110 or 210 are preferably closed to prevent separation of the centroid member 230 from the load member 110 or 210.

In consideration of the role of the centroid member 230 in the accessory 100 or 200 according to the present invention, in the case of the semi-cylindrical accessory 200 illustrated in FIG. 4, the centroid member 230 is preferably fixedly coupled to the center of the outer circumference of the accessory 200 because it is preferable that the center of the outer circumference is the center of gravity in terms of wrinkle smoothing effects.

The load member 110 or 210, the anti-slip members 120 or 220, and the centroid member 230 as described above may be integrally formed with one another by injection molding, or may be individually fabricated and assembled to one another.

According to another embodiment of the present invention, the length of the load member may be variable based on the width of clothes to which the load member will be inserted.

The load member 110 or 210 is preferably length-adjustable. That is, the load member 110 or 210 is preferably expandable to enable adjustment in the length thereof. Namely, a length of the load member 110 or 210 may vary according to a width of pants.

Figure 8:
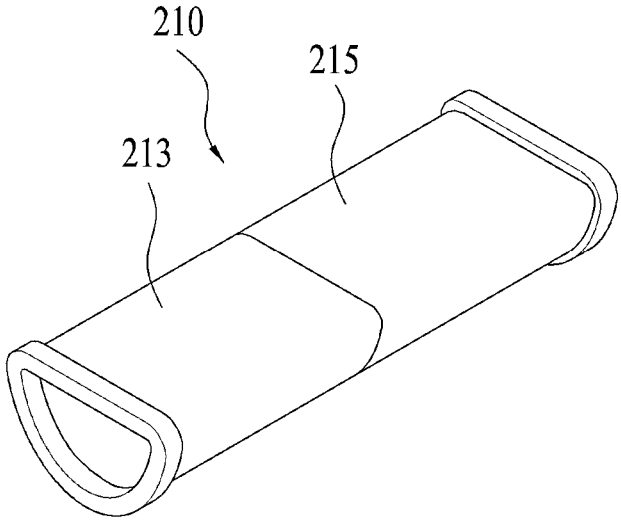
FIG. 8 is a perspective view illustrating an accessory for the clothes dryer according to a further embodiment of the present invention.
Figure 9:
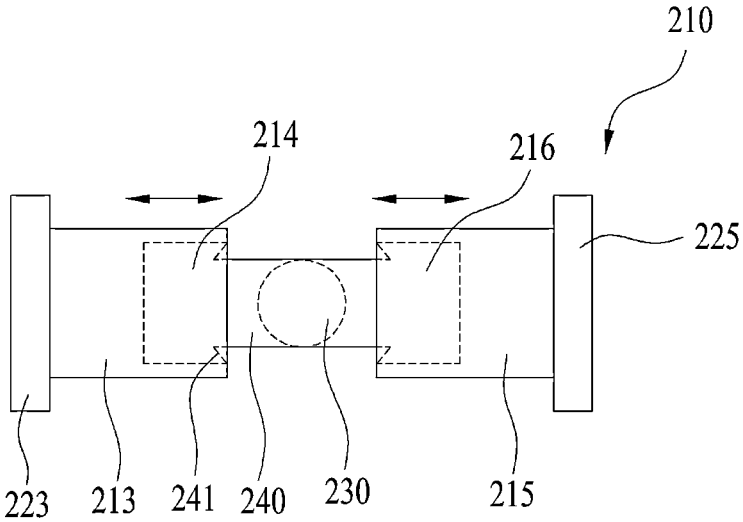
FIG. 9 is a plan view of the accessory for the clothes dryer illustrated in FIG. 8.

Referring to FIGS. 8 and 9, the load member 210 according to a further embodiment of the present invention may include a first load member 213 and a second load member 215. Also, a connection member 240 may further be provided, one end of which is coupled to the first load member 213 and the other end of which is coupled to the second load member 215.

The first load member 213 and the second load member 215 are provided as separate elements, and may be coupled to each other to constitute the single load member 210. Although the present embodiment describes the load member 210 as being divided into two load members, the present invention is not limited thereto, and the load member 210 may include two or more sub load members.

The first load member 213 and the second load member 215 preferably have the same shape and weight. The first load member 213 and the second load member 215 may respectively have inserting regions 214 and 216 for insertion of the connection member 240. The inserting regions 214 and 216 take the form of recesses. More specifically, the inserting region 214 is formed in one end of the first load member 213 and the inserting region 216 is formed in one end of the second load member 215. Preferably, the inserting regions 214 and 216 are formed in facing ends of the first load member 213 and the second load member 215. The anti-slip members 223 and 225 are provided at opposite sides of the inserting regions 214 and 216.

The connection member 240 functions to connect the first load member 213 and the second load member 215 to each other. The connection member 240 may have an elongated bar shape. One end of the connection member 240 may be inserted into the inserting region 214 of the first load member 213 and the other end of the connection member 240 may be inserted into the inserting region 216 of the second load member 215. As such, the length of the load member 210 is variable according to the length of portions of the connection member 240 inserted into the inserting regions 214 and 216. That is, in a state in which the connection member 240 is completely inserted into the inserting regions 214 and 216, one end of the first load member 213 and one end of the second load member 215 continuously come into contact with each other (see FIG. 8). In this case, the connection member 240 is not exposed to the outside. On the other hand, if the user laterally pulls at least one of the first load member 213 and the second load member 215 in order to extend the length of the load member 210, a portion of the connection member 240 is separated from at least one of the inserting regions 214 and 216, and thus the length of the load member 210 may be extended (see FIG. 9). In the present embodiment, the centroid member 230 may be located inside the connection member 240.

In this case, stoppers 241 are preferably formed at both ends of the connection member 240. The stoppers 241 serve to prevent the connection member 240 from being completely separated from the inserting regions 214 and 216. The stoppers 241 may be provided at more than one end of the connection member 240, and may take the form of bosses. If the user excessively pulls at least one of the first load member 213 and the second load member 215 in order to extend the length of the load member 210, the connection member 240 may be completely separated from the inserting regions 214 and 216 of the first load member 213 and the second load member 215. Thus, providing the connection member 240 with the stoppers 241 may prevent complete separation of the connection member 240 from the inserting regions 214 and 216.

Figure 10:
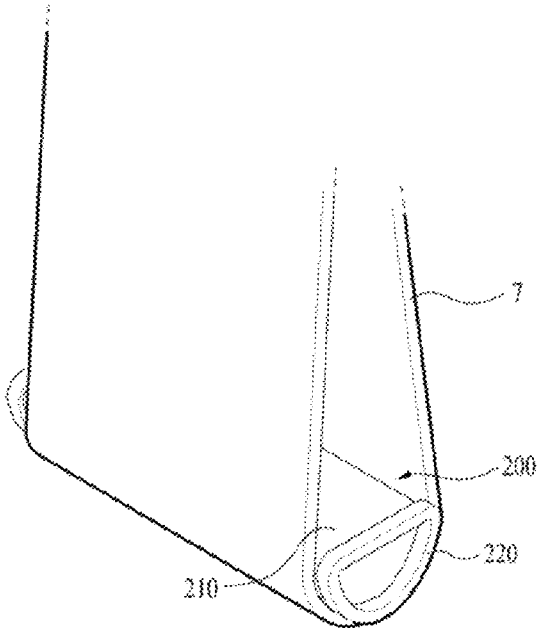
FIG. 10 is a view illustrating a use state of the accessory for the clothes dryer illustrated in FIG. 4 according to the embodiment of the present invention.

One embodiment of the accessory 100 or 200 for the clothes dryer according to the present invention is illustrated in FIG. 10.

FIG. 10 is a view illustrating a use state of the accessory 200 for the clothes dryer of FIG. 4 according to the embodiment of the present invention. It is clearly understood that the illustrated use state may be applied to the accessory 100 for the clothes dryer illustrated in FIG. 7 according to another embodiment of the present invention.

Referring to FIG. 10, although the accessory 100 or 200 for the clothes dryer according to the present invention is illustrated as being used in the pants 7, it is clearly understood that the use range of the accessory is not limited to the pants 7.

In the drawing, after one end and the other end of the half folded pants 7 are fixed to the clothes hanger 6, the clothes hanger 6 is hung on a supporting member 5 protruding inward from a door of the cabinet 1 of the clothes dryer. Next, the accessory 100 or 200 for the clothes dryer according to the present invention is laterally inserted into the folded portion of the pants 7. Once the accessory 100 or 200 for the clothes dryer has been inserted into the pants 7, the accessory 100 or 200 may be automatically slightly rotated owing to the centroid member 230 accommodated in the load member 110 or 210 to thereby be positioned in place, or may be manually positioned in place by the user. In this way, as the accessory 100 or 200 positioned in place downwardly applies tension to the pants 7, the accessory 100 or 200 acts to smooth out the wrinkles in the clothes 7 to be dried under a steam or hot air environment within the cabinet 1 of the clothes dryer 10.

It will be understood that the user can intuitively know the above-described use method of the accessory 100 or 200, and thus the accessory 100 or 200 ensures more enhanced practicality than the above-described fixing clamps 20 and 30.

Figure 11A:
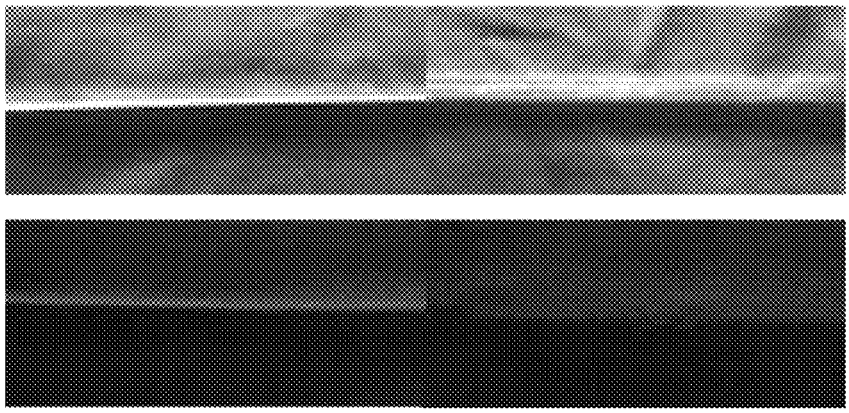
FIG. 11A is a view comparing wrinkle smoothing effects of pants before and after drying in the case in which the accessory for the clothes dryer is not used.
Figure 11B:
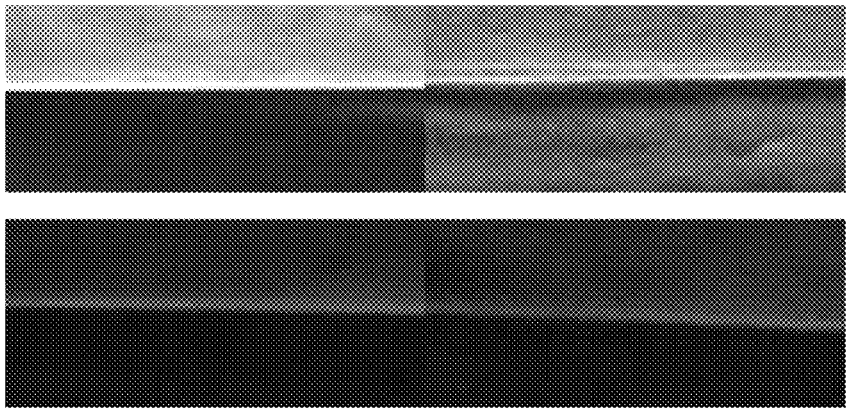
FIG. 11B is a view comparing wrinkle smoothing effects of pants before and after drying in the case in which the accessory for the clothes dryer is used.

FIG. 11A is a view comparing wrinkle smoothing effects of the pants 7 before and after drying in the case in which the accessory 100 or 200 for the clothes dryer according to the present invention is not used, and FIG. 11B is a view comparing wrinkle smoothing effects of the pants before and after drying in the case in which the accessory 100 or 200 for the clothes dryer according to the present invention is used.

In FIG. 11B, the accessory 200 for the clothes dryer according to the embodiment of the present invention illustrated in FIG. 4 is used. More specifically, the accessory 200 for the clothes dryer, which is a semi-cylindrical accessory having the weight of 800 g and the radius of curvature of 120 mm, was used in the experiment.

In FIGS. 11A and 11B, the same pants are used as a comparative subject in the experiment. In the respective drawings, the upper part shows experimental results of cotton pants, and the lower part shows experimental results of wool pants.

Also, in the respective drawings, the left side and the right side show experimental results after and before drying of the pants.

As can be clearly appreciated from the results, the pants as illustrated in FIG. 11B, i.e., the pants, to which the accessory for the clothes dryer according to the present invention is applied, exhibit superior wrinkle smoothing effects and the sharpness of originally formed pleats.

As is apparent from the above description, the present invention provides the following effects owing to the above-described technical features.

Firstly, through use of the accessory for the clothes dryer, it is possible not only to efficiently smooth out the wrinkles in clothes to be dried, but also to pleat the clothes.

Secondly, it is possible to achieve superior durability and low manufacturing costs owing to a relatively simple configuration of the accessory for the clothes dryer.

Thirdly, it is possible to achieve excellent effects in terms of practicality by allowing the user to intuitively know a use method of the accessory for the clothes dryer.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. An accessory for a clothes dryer, the accessory comprising: a load member which is inserted into a predetermined portion of clothes in a state in which the cloths are accommodated in the clothes dryer and which serves to downwardly apply tension to the clothes; and at least one anti-slip member configured to prevent the load member from being separated from the clothes, wherein the at least one anti-slip member includes two anti-slip members provided respectively at both longitudinal ends of the load member, wherein the anti-slip members define stepped portions at both longitudinal ends of the load member, wherein each anti-slip member is separably coupled to the load member, and wherein each anti-slip member includes a recess or protrusion to be coupled to the load member, and the load member includes a protrusion or recess corresponding to the recess or protrusion of the anti-slip member.

2. The accessory according to claim 1, wherein the load member is inserted into a folded portion of the clothes in a state in which the folded clothes are accommodated in the clothes dryer.

3. The accessory according to claim 1, wherein the load member has an elongated bar shape.

4. The accessory according to claim 3, wherein at least a portion of an outer circumference of the load member is curved.

5. The accessory according to claim 4, wherein the load member has a streamlined semicircular cross section.

6. The accessory according to claim 4, wherein the load member has a circular cross section.

7. The accessory according to claim 6, wherein the anti-slip member is formed of a stainless material or thermosetting resin.

8. The accessory according to claim 3, wherein the load member is formed of a stainless material or thermosetting resin.

9. The accessory according to claim 3, further comprising a centroid member which serves as the center of gravity of the load member to prevent the load member from being rotated in the folded portion of the clothes.

10. The accessory according to claim 9, wherein the centroid member is movably located inside the load member.

11. The accessory according to claim 9, wherein the centroid member is fixed inside the load member.

12. The accessory according to claim 9, wherein the load member and the centroid member are integrally formed with each other.

13. The accessory according to claim 3, wherein the load member is length-adjustable to enable adjustment in the length thereof.

14. The accessory according to claim 13, wherein the load member includes: a first load member; a second load member; and a connection member configured to connect the first and second load members to each other, wherein one end of the connection member is coupled to the first load member and the other end of the connection member is coupled to the second load member.

15. The accessory according to claim 14, wherein at least one of the first load member and the second load member includes an inserting region, into which the connection member is inserted, and the length of the load member varies according to the length of a portion of the connection member inserted into the inserting region.

16. The accessory according to claim 15, wherein at least one of both ends of the connection member is provided with a stopper to prevent the connection member from being separated from the inserting region.

* * * * *